US007013096B2

(12) United States Patent
Ozawa et al.

(10) Patent No.: US 7,013,096 B2
(45) Date of Patent: Mar. 14, 2006

(54) IMAGE FORMING APPARATUS WITH TONER AMOUNT SELECTION FEATURE

(75) Inventors: Ichiro Ozawa, Funabashi (JP); Yoshiaki Kobayashi, Numazu (JP); Hideaki Suzuki, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 24 days.

(21) Appl. No.: 10/765,169

(22) Filed: Jan. 28, 2004

(65) Prior Publication Data

US 2004/0184826 A1 Sep. 23, 2004

Related U.S. Application Data

(63) Continuation of application No. 09/793,130, filed on Feb. 27, 2001, now abandoned.

(30) Foreign Application Priority Data

Mar. 1, 2000 (JP) ..... 2000-056294
Feb. 26, 2001 (JP) ..... 2001-050386

(51) Int. Cl.
*G03G 15/08* (2006.01)

(52) U.S. Cl. ..... 399/58; 399/63

(58) Field of Classification Search ..... 399/58, 399/61, 62, 63, 47, 51, 53, 258; 347/140, 347/158; 118/688, 689
See application file for complete search history.

(56) References Cited

U.S. PATENT DOCUMENTS

| | | | | |
|---|---|---|---|---|
| 4,589,762 | A | 5/1986 | De Schamphelaere et al. | 118/689 |
| 4,611,905 | A | 9/1986 | De Schamphelaere et al. | 118/689 |
| 4,626,096 | A | 12/1986 | Ohtsuka et al. | 399/27 |
| 4,847,659 | A | 7/1989 | Resch, III | 399/58 |
| 5,124,751 | A | 6/1992 | Fukui et al. | 399/44 |
| 5,581,326 | A | 12/1996 | Ogata et al. | 399/30 |
| 5,754,916 | A | 5/1998 | Kitayama et al. | 222/DIG. 1 |
| 5,937,227 | A | 8/1999 | Wong et al. | 399/49 |
| 6,104,892 | A | 8/2000 | Kobayashi et al. | 399/63 |
| 6,332,063 | B1 | 12/2001 | Ozawa et al. | 399/27 |
| 6,345,162 | B1 | 2/2002 | Ozawa et al. | 399/61 |

FOREIGN PATENT DOCUMENTS

| | | |
|---|---|---|
| JP | 60-49362 | 3/1985 |
| JP | 62-3269 | 1/1987 |
| JP | 5-27596 | 2/1993 |
| JP | 10-333419 | 12/1998 |

*Primary Examiner*—Robert Beatty
(74) *Attorney, Agent, or Firm*—Fitzpatrick, Cella, Harper & Scinto

(57) ABSTRACT

An image forming apparatus includes an image bearing member on which a latent image corresponding to image information is formed, a developing device for developing the latent image on said image bearing member with a developer including carrier and toner, a supplying device for supplying a developer to the developing device, a detector for detecting information corresponding to the magnetic permeability of the developer, and a selecting device for selecting modes on the basis of the information detected by the detecting device, wherein the selecting device can select a first control mode that controls the amount of the developer which is supplied to the developing device by the supplying device on the basis of the information detected by the detector, and a second control mode that controls the amount of the developer which is supplied to the developing device by the supplying device on the basis of the image information.

11 Claims, 8 Drawing Sheets

IMAGE FORMING APPARATUS WITH TONER AMOUNT SELECTION FEATURE

CROSS-REFERENCE TO RELATED APPLICATION

This application is a continuation of application Ser. No. 09/793,130 filed Feb. 27, 2000, now abandoned.

BACKGROUND OF THE INVENTION

1. Field of the Invention

The present invention relates to an image forming apparatus using an electrophotographic system or an electrostatic recording system, for example, an image forming apparatus such as a copying machine, a printer or a facsimile.

2. Related Background Art

Up to now, a developing device equipped in an image forming apparatus of the electrophotographic system or the electrostatic recording system uses a two-component developer essentially including toner particles and carrier particles. In particular, in a color image forming apparatus that forms a full color or a multicolor image through the electrophotographic system, most of the developing devices use two-component developers from the viewpoint of hue, tone, or the like of the image.

As well known, the toner density of the two-component developer, that is, a rate of the toner weight to the total weight of the carrier particles and the toner particles becomes a very important element in stabilization of the image quality. The toner particles of the developer is consumed at the time of development, and thereafter the toner density of the developer is reduced. For that reason, it is important that an automatic toner replenishing controller (ATR) is employed to accurately detect the toner density of the developer in good time, to replenish the toner in accordance with a change in the toner density, always to constantly control the toner density and keep the image quality.

As described above, in order to correct the change in the toner density within the developing device due to development, that is, in order to control the toner amount which is replenished to the developing device, developer density detectors of various types which are disposed within the developing container have been put in practical use.

For example, there has been employed an optical developer density controller, a developer density controller of an inductance detecting type, or the like, which is disposed in the vicinity of a developer bearing member (hereinafter referred to as "developing sleeve" since, in general, the developing sleeve is frequently used), or a developer carrying path of the developing container. The optical developer density controller grasps the toner density and controls the toner amount which is replenished to the developing device by utilizing a phenomenon that a reflection factor of a light irradiated onto a developer carried on the developing sleeve or a developer within the developing container is different depending on the toner density. The developer density controller of the inductance detecting type grasps the toner density within the developing container in accordance with a detection signal from an inductance head that detects an apparent magnetic permeability due to the mixture ratio of the magnetic carrier and the nonmagnetic toner in the developer and converts the detection signal from the inductance head into an electric signal, and replenishes the toner on the basis of a comparison of the toner density with a reference value.

Also, there is a system in which an image density of a patch formed on an image bearing member (hereinafter referred to as "photosensitive drum" since in general, the photosensitive drum is frequently used) is read by a light source disposed on a position that faces the surface of the image bearing member and a sensor that receives its reflected light, and then converted into a digital signal by an analog-to-digital converter, and thereafter the digital signal is transmitted to a CPU and then compared with an initial set value in the CPU. In the system, if the image density is higher than the initial set value, the toner replenishment stops until the image density returns to the initial set value whereas if the image density is lower than the initial set value, the toner is forcedly replenished until the image density is returned to the initial set value, and the toner density is indirectly maintained to a desired value.

Further, there is a developer density controller called "a video count system" in which a consumed toner amount is estimated on the basis of a video count of an image density signal corresponding to the image information of an original read by such as the CCD, and the toner corresponding to the estimated consumed toner amount is replenished.

However, in the system the toner density is detected from the reflection factor of the light irradiated onto the developer carried on the developing sleeve or the developer within the developing container, if the sensor is stained by toner scattering or the like, there is a case in which the toner density cannot be accurately grasped and detected.

Also, in the system that indirectly controls the toner density from the patch image density, with the downsizing of the image forming apparatus, disenables a space where a patch image is formed or a space where a detecting means is located to be ensured.

Further, the toner replenishment due to the video count system is so controlled as to be set to an appropriate developer density more rapidly than if more toner is consumed due to a high-density image since the toner replenishment amount is calculated every time the image forming operation is conducted.

However, in the case where there is even a slight difference between the consumed toner amount calculated on the basis of the video count and the toner replenishment amount due to a precision of the toner hopper that conducts the toner replenishment or the like, if images are formed (developed) on a large amount of transfer materials (paper or the like), because the developer density is gradually shifted from an initial appropriate developer density, it may be difficult to control the developer density with only the video count system.

On the other hand, the above developer density controller of the inductance detecting system (hereinafter referred to as "inductance detecting system ATR") does not suffer from the above problem, and controls the toner amount which is replenished to the developing device on the basis of the following control. That is, for example, if it is detected that the apparent magnetic permeability of the developer is large, a rate at which the carrier particles in the developer is occupied in a constant volume becomes large, which means that the toner density becomes low. Therefore, the toner replenishment starts. Conversely, if the apparent magnetic permeability becomes small, the rate at which the carrier particles in the developer is occupied in the constant volume becomes small, which means that the toner density becomes high. Therefore, the toner replenishment stops.

However, in the above-mentioned inductance detecting system ATR, there is a case in which the output from the inductance head in correspondence with the apparent magnetic permeability is discontinuously changed due to a change in a bulk density of the developer due to the leaving of the developer or an environmental variation between a time immediately before the operation of the image forming apparatus stops (for example, immediately before the main switch of the image forming apparatus is switched off) and a time immediately after the image forming apparatus restarts (for example, immediately after the main switch of the image forming apparatus is switched on).

In other words, that the bulk density of the developer is changed within the developing container even if the toner amount in the developing container does not substantially change between a time immediately before the operation of the image forming apparatus stops (for example, immediately before the main switch of the image forming apparatus turns off) and a time immediately after the operation restarts (for example, immediately after the main switch of the image forming apparatus turns on), means that the amount of developer (carrier particles)within the constant volume in the vicinity of the sensor changes in the inductance detecting system ATR. As a result, there is a case in which the toner is replenished in response to an output signal from the head indicating that the toner has been decreased regardless of the toner amount being not substantially changed.

In this case, there may occur a problem that the image density becomes high due to the excessive toner replenishment, a problem that the amount of developer increases with an increase of the toner amount to the degree that the developing container overflows with the developer, or a problem that the toner is scattered due to a deterioration of the charge amount of the toner with an increase in the ratio of toner in the developer.

Also, the above-described problems are particularly remarkable in the case where a stop period of time after the stoppage of the image forming apparatus and before the restart of the image forming apparatus is long, or in the case where the environmental variation is large during that stop period of time.

SUMMARY OF THE INVENTION

The present invention has been made in order to solve the above problems, and therefore an object of the present invention is to provide an image forming apparatus which is capable of appropriately maintaining the amount of a developer which is replenished to a developing means even if a correlation between the amount of developer within the developing means and information detected by a detecting means is largely deviated.

Another object of the present invention will become apparent by reading the following detailed description.

BRIEF DESCRIPTION OF THE DRAWINGS

These and other objects and advantages of this invention will become more fully apparent from the following detailed description taken with the accompanying drawings in which.

DESCRIPTION OF THE PREFERRED EMBODIMENTS

Now, a description will be given in more detail of an image forming apparatus according to the present invention.

The image forming apparatus to which the present invention is applicable may be structured in such a manner that a latent image is formed on a photosensitive member or a dielectric in response to an image information signal of an original through such as an electrophotographic system or an electrostatic recording system, the latent image is developed by a developing device using a two-component developer essentially including toner particles and carrier particles to form a visible image (toner image), and the visible image is transferred onto a transfer material such as a sheet of paper and made into a permanent image by a fixing means. The present invention can be also applied to an image forming apparatus in which a latent image corresponding to image information transmitted from a personal computer or the like through a network cable is formed on the photosensitive member or the dielectric and then developed.

First Embodiment

A first embodiment of the present invention will be described with reference to FIGS. 1, 2 and 3A to 3D.

First, the entire structure of an image forming apparatus in accordance with one embodiment of the present invention will be described with reference to FIG. 1. This embodiment shows an example in which the present invention is applied to a digital copying machine of the electrophotographic system, but it is needless to say that the present invention can be similarly applied to other various image forming apparatuses of the electrophotographic system and the electrostatic recording system.

Figure 1:
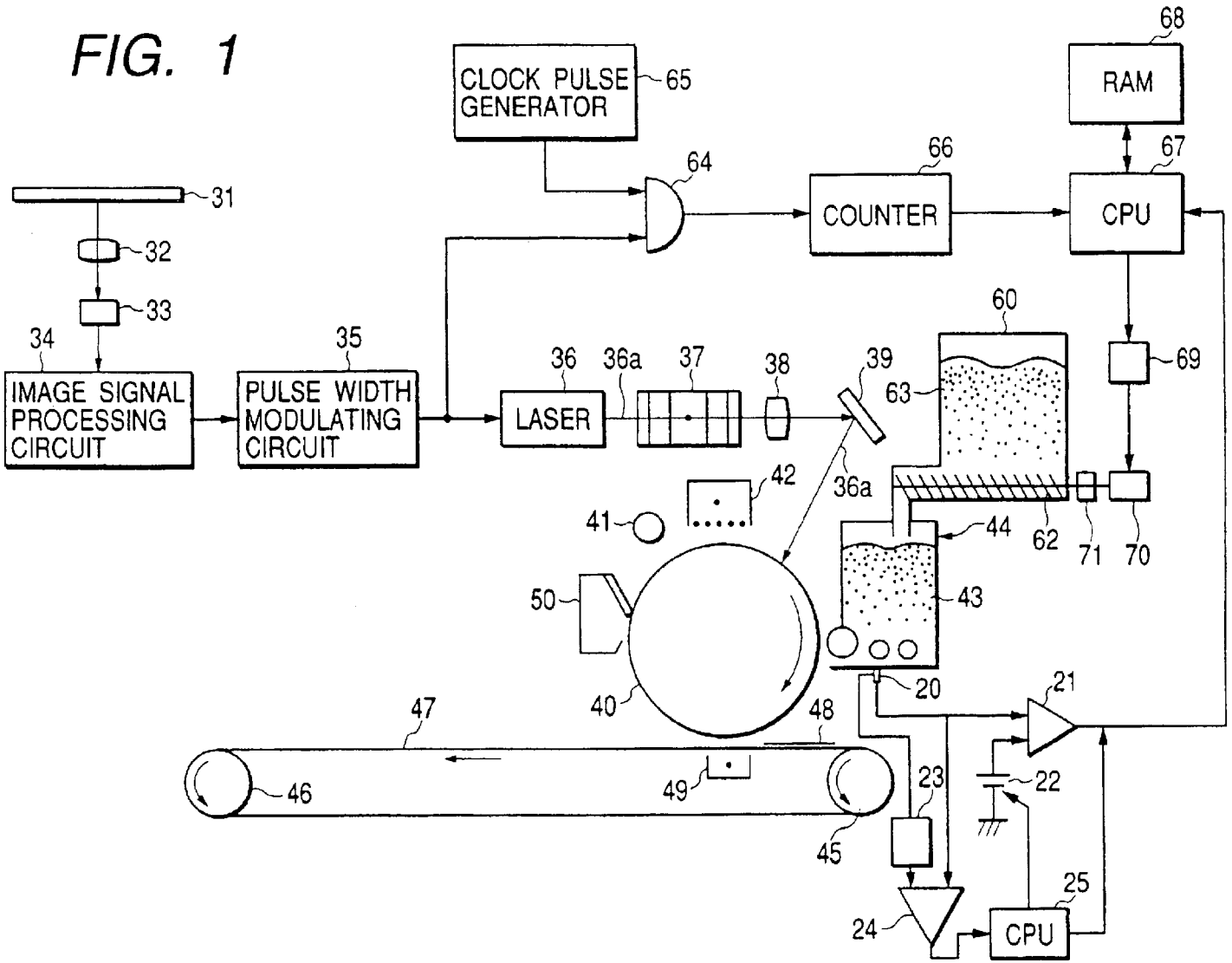
FIG. 1 is a diagram showing the entire structure of an image forming apparatus in accordance with one embodiment of the present invention.

Referring to FIG. 1, an image of an original 31 to be copied is projected onto an image pickup element 33 such as a CCD by a lens 32. The image pickup element 33 resolves the original image into a large number of pixels and generates photoelectric conversion signals corresponding to the densities of the respective pixels. An analog image signal outputted from the image pickup element 33 is transmitted to an image signal processing circuit 34 so as to be converted into a pixel image signal having an output level corresponding to the density of each pixel and then transmitted to a pulse width modulating circuit 35.

Figure 3A:
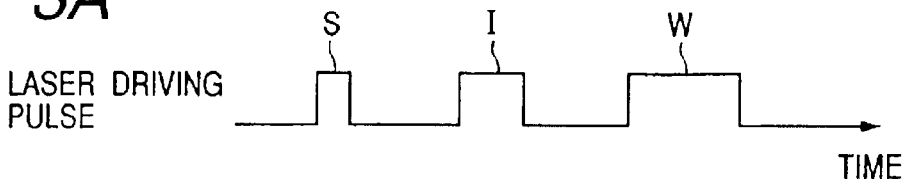
FIGS. 3A, 3B, 3C and 3D are waveform diagrams for explaining a method of counting image information signals in the image forming apparatus shown in FIG. 1.
Figure 3B:
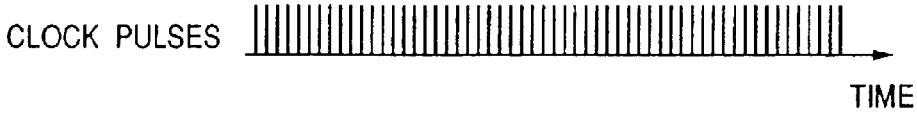

The pulse width modulating circuit 35 forms a laser driving pulse having a width (time length) corresponding to the level for each input pixel image signal and outputs the laser driving pulse. That is, as shown in FIG. 3A, a wider width driving pulse W is formed for a high-density pixel image signal, a narrower width driving pulse S is formed for a low-density pixel image signal, and a medium width driving pulse I is formed for a medium density pixel image signal, respectively.

The laser driving pulse outputted from the pulse width modulating circuit 35 is supplied to a semiconductor laser 36 to allow the semiconductor laser 36 to emit a light for only a period of time corresponding to the pulse width. Accordingly, the semiconductor laser 36 is driven for the high density pixel for a longer period of time, and driven for the low density pixel for a shorter period of time. Therefore, the photosensitive drum 40 is exposed in a long range in a main scanning direction with respect to the high density pixel and exposed in a shorter range in the main scanning direction with respect to the low density pixel, through an optical system which will be described below. In other words, the dot size of an electrostatic latent image is different in correspondence with the density of the pixel.

Figure 3C:
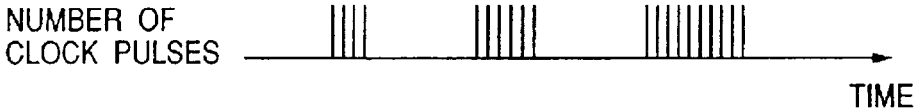
Figure 3D:
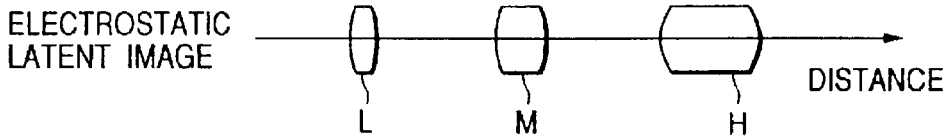

Accordingly, it is needless to say that the consumed toner amount with respect to the high density pixel is larger than that with respect to the low density pixel. In FIG. 3D, the electrostatic latent images of the low, medium and high density pixels are indicated by L, M and H, respectively.

A laser beam 36*a* irradiated from the semiconductor laser 36 is swept by a rotary polygon mirror 37 and then spot-imaged on the photosensitive drum 40 by a stationary mirror 39 that directs the laser beam 36*a* through a lens 38 such as an f/θ lens to the photosensitive drum 40 which is an image bearing member. Thus, the laser beam 36*a* scans the photosensitive drum 40 in a direction which is substantially in parallel with the its rotating axis (main scanning direction) and forms an electrostatic latent image.

The photosensitive drum 40 as an image bearing member is an electrophotographic photosensitive drum that has a photoconductor such as amorphous silicon, selenium or OPC on its surface and rotates in a direction indicated by an arrow. The photosensitive drum 40 is uniformly charged by a primary charger 42 after it has been subjected to uniform charge elimination by an exposing device 41. Thereafter, exposure scanning is conducted by the laser beam 36*a* which has been modulated in accordance with the above-described image information signal, to thereby form the electrostatic image corresponding to the image information. The electrostatic latent image is reversely developed by a developing device 44 using a two-component developer 43 where the toner and the carrier are mixed together to form a visible image (toner image). In this example, the reversal development is directed to a developing method in which toner charged with the same polarity as the latent image is stuck onto a region of the photosensitive drum 40 which is exposed by a light and visualized.

The toner image is transferred onto a transfer material 48 which has been conveyed to the photosensitive drum 40 by a transfer material bearing belt 47 as a transfer rotary member, by the action of a transfer charger 49. A transfer material bearing belt 47 is put around two rollers 45 and 46 and driven in an endless manner in a direction indicated by an arrow in the FIG. 1, to thereby convey the transfer material 48 borne on the transfer material bearing belt 47 to the photosensitive drum 40. The transfer material 48 onto which the toner image has been transferred is separated from the transfer material bearing belt 47 and then conveyed to a fixing device not shown so as to be fixed into a permanent image. Also, the residual toner remaining on the photosensitive drum 40 after the transfer operation is thereafter removed by a cleaner 50.

For simplification of description, only a single image forming station (including the photosensitive drum 40, the exposing device 41, a primary charger 42, the developing device 44, or the like) is shown. In fact, the image forming apparatus according to this embodiment is a color image forming apparatus having image forming stations for the respective colors consisting of, for example, cyan, magenta, yellow and black. The respective image forming stations are arranged on the transfer material bearing belt 47 in order along the moving direction, and electrostatic latent images for the respective colors (for each of the color components of the image) obtained by color-separating the original image are sequentially formed on the photosensitive drums of the respective image forming stations and then developed by the developing devices 44 using developers having the corresponding color toners and sequentially superimposed on each other and transferred onto the transfer material 48 which is conveyed by the transfer material bearing belt 47.

Figure 2:
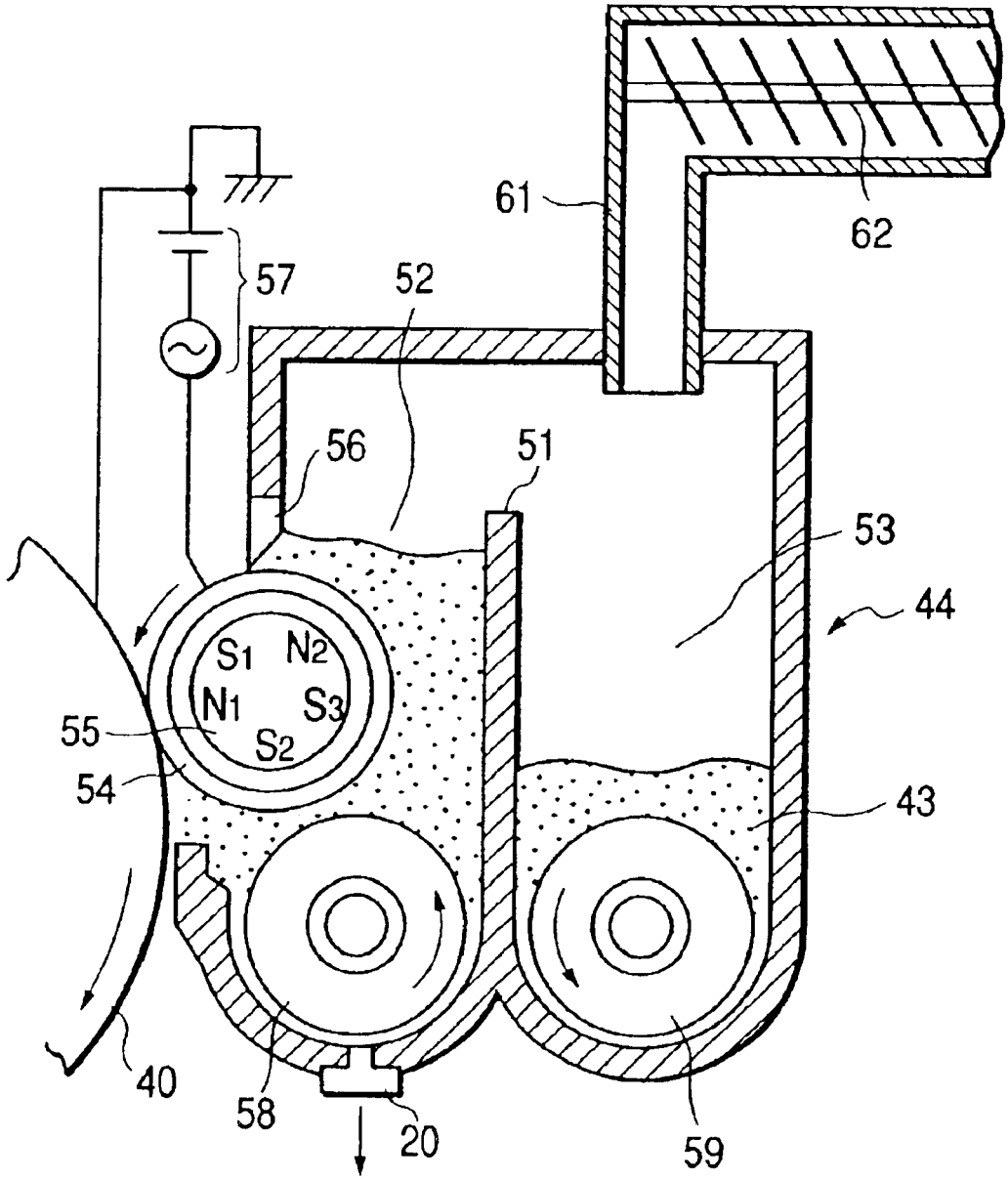
FIG. 2 is a schematic diagram showing the structure of a developing device equipped in the image forming apparatus shown in FIG. 1.

An example of the above developing device 44 is shown in FIG. 2. As shown in FIG. 2, the developing device 44 according to this embodiment is arranged so as to face the photosensitive drum 40, and the interior of the developing device 44 is sectioned into a first chamber (developing chamber) 52 and a second chamber (agitating chamber) 53 by a partition wall 51 serving as a partition that extends in a vertical direction. In the first chamber 52 are disposed a nonmagnetic developing sleeve 54 serving as a developer bearing member-that rotates in a direction indicated by an arrow, and a magnet 55 which is a magnetic field generating means is arranged within the developing sleeve 54 in an stationary manner.

The developing sleeve 54 bears and carries a layer of a two-component developer (including a magnetic carrier and a non-magnetic toner) a thickness of which is regulated by a blade 56 and supplies the developer to the photosensitive drum 40 in a developing region that is opposite to the photosensitive drum 40 to reversely develop the electrostatic latent image (in this embodiment, the charge polarity of the photosensitive drum and the charge polarity of the toner are negative).

In order to improve the developing efficiency, that is, the efficiency of transferring the toner to the latent image, a developing bias voltage where a d.c. voltage is superimposed on an a.c. voltage (a negative voltage in this embodiment) is applied from a power supply 57 to the developing sleeve 54.

First and second developer agitating screws 58 and 59 which serve as developer agitating members are disposed within the first chamber 52 and the second chamber 53. The first screw 58 agitates and carries the developer 43 within the first chamber 52, and the second screw 59 agitates and carries a toner 63 supplied from a toner discharge port 61 of a toner replenishing tank 60 (replenishing means) which will be described later by the rotation of a carrying screw 62

(replenishing means) and the developer 43 which has already been stored in the developing device 44 and uniform the toner density. The partition wall 51 is formed with a developer passage (not shown) which mutually communicates the first chamber 52 and the second chamber 53 at end portions at a front side and a back side in FIG. 2. The developer within the first chamber 52 with the toner density of which has been lowered due to the toner being consumed by development is moved through one passage to the second chamber 53 by the carrying forces of the first and second screws 58 and 59, and the developer the toner density of which has been recovered within the second chamber 53 is moved through another passage to the first chamber 52.

In order to correct a change in the developer density within the developing device 44 which is caused by the development of the electrostatic latent image, namely, in order to control the toner amount that is replenished to the developing device 44, according to this embodiment, there is disposed the inductance detecting system ATR (first control mode), that is, a first developer density controller in which an inductance head 20 is located on a bottom wall of the first chamber (developing chamber) 52 of the developing device 44, an actual toner density of the developer 43 within the developing device 44, specifically within the first developing chamber 52, is grasped in accordance with an output signal from the inductance head 20, and the toner is replenished on the basis of a comparison of the actual toner density with a reference value.

Figure 4:
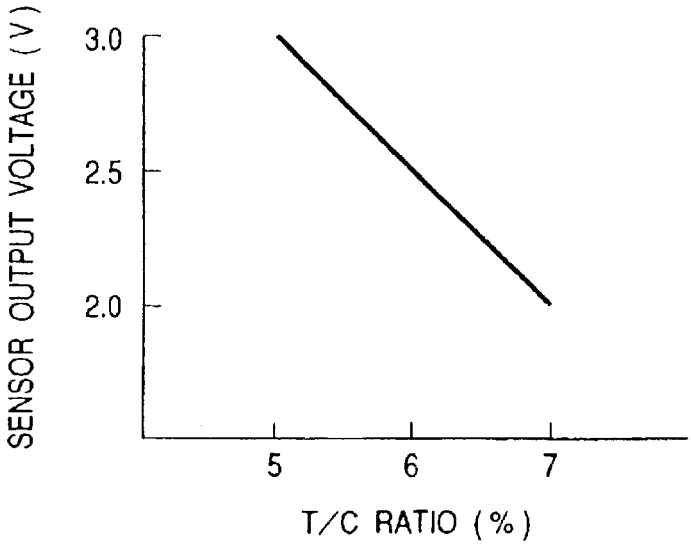
FIG. 4 is a characteristic diagram showing a state in which a detection signal from an inductance head is changed by a change in the toner density of a developer.

As described above, the two-component developer essentially includes the magnetic carriers and the nonmagnetic carriers, and the apparent magnetic permeability due to the mixture ratio of the magnetic carriers (C for short) and the nonmagnetic toner (T for short) changes when the toner density of the developer 43 (the rate of the toner particle weight with respect to the total weight of the carrier particles and the toner particles) changes. When the apparent magnetic permeability is detected by the inductance head 20 and then converted into an electric signal, the electric signal (sensor output voltage (v)) is substantially linearly changed in accordance with the toner density (T/C ratio (t)) as shown in FIG. 4. That is, the electric signal outputted from the inductance head 20 corresponds to an actual toner density of the two-component developer within the developing device 44. The electric signal outputted from the inductance head 20 is supplied to one input of a comparator 21 The other input of the comparator 21 is inputted with a reference electric signal corresponding to the apparent magnetic permeability of a regular toner density (the toner density in an initial set value) of the developer 43 from a reference voltage signal supply 22 Accordingly, the comparator 21 compares the regular toner density with the actual toner density within the developing device 44, and a detection signal of the comparator 21 as the comparison result of both of the input signals is supplied to a CPU 67 serving as a control means.

The CPU 67 controls the operation so as to correct a subsequent toner replenishing period of time on the basis of the detection signal from the comparator 21. For example, if the actual toner density of the developer 43 detected by the inductance head 20 is smaller than the regular value, that is, if the toner is short in replenishment, the CPU 67 actuates the carrying screw 62 within the toner replenishing tank 60 so as to replenish the short amount of toner to the developing device 44. That is, the CPU 67 calculates the screw rotating period of time required for replenishing the short amount of toner to the developing device 44 on the basis of the detection signal from the comparator 21, controls a motor driving circuit 69 (replenishing means) so as to rotationally drive a motor 70 for the calculated screw rotating period of time and rotates the carrying screw 62 within the toner replenishing tank 60 through a gear train 71, to thereby replenish the short amount of toner to the developing device 44.

Also, if the actual toner density of the developer 43 which has been detected by the inductance head 20 is larger than the regular value, that is, in the case the toner is excessively replenished, the CPU 67 calculates the excessive toner amount in the developer on the basis of the detection signal from the comparator 21. Then, in the subsequent original image formation, an image is formed without replenishing the toner until the excessive toner amount is consumed, that is, the image is formed without supplying the toner so that the excessive toner amount is consumed, and when the excessive toner amount is consumed, the above-mentioned toner replenishing operation is conducted.

Figure 5:
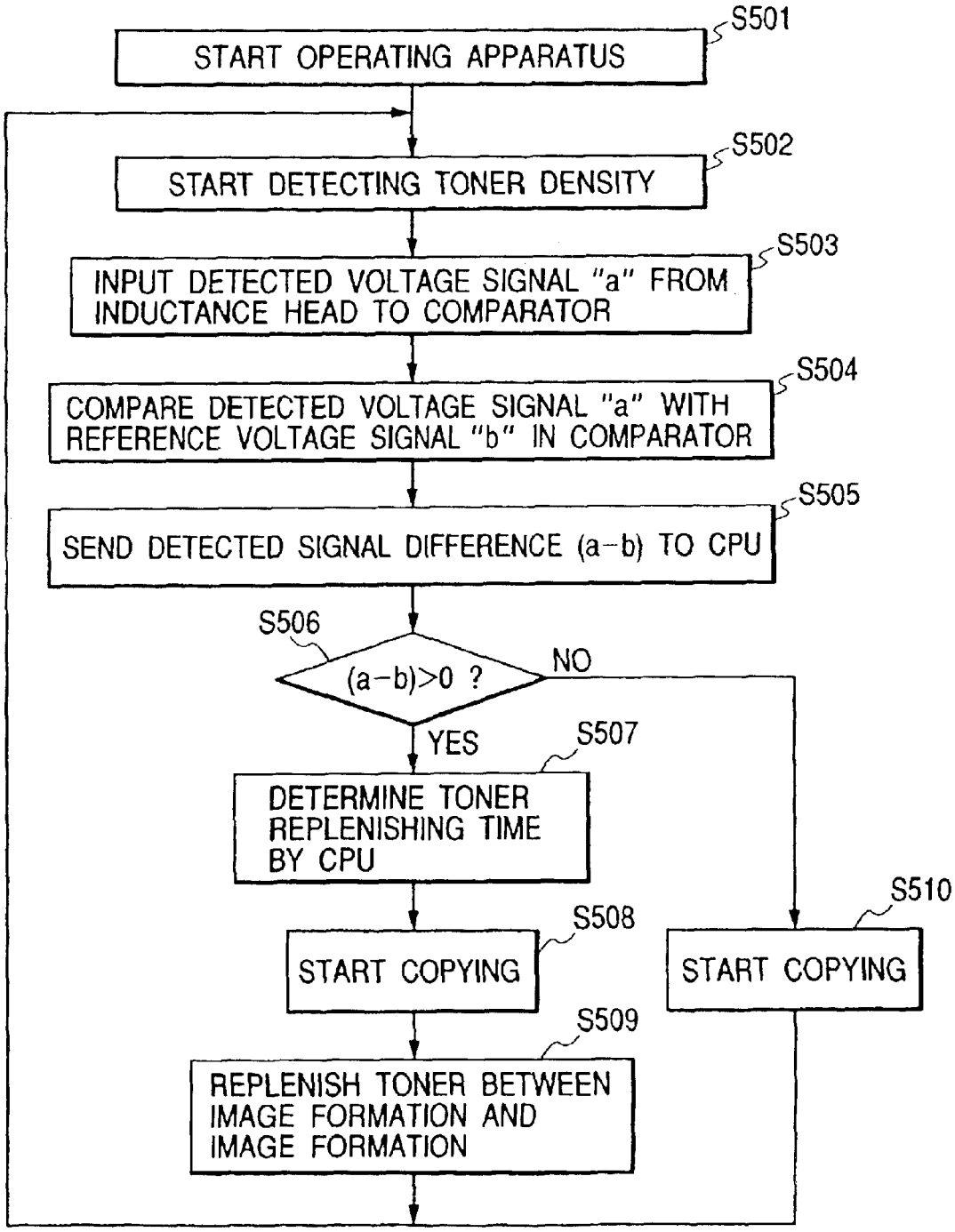
FIG. 5 is a flowchart for explaining the basic operation of one embodiment of the present invention.

Subsequently, the above operation will be further described with reference to a flowchart shown in FIG. 5.

First, when the image forming apparatus starts (S501), the toner density detection starts (S502). Then, a detected voltage signal "a" from the inductance head 20 is inputted to the comparator 21 (S503) and compared with a reference voltage signal "b" from a reference voltage signal source 22 by the comparator 21 (S504). It is judged whether or not the detected signal difference (a−b) is larger 0 ((a−b)>0) (S506), and if the toner density is lower than the reference value (yes), a toner replenishing time is determined (S507). Then, copying operation starts (S508), and toner replenishment is conducted between an image formation and an image formation for only the toner replenishing time (S509), and the operation returns to the start.

Also, if the toner density is higher than the reference value (no) in S506, the copying operation starts (S510) and the operation returns to the start without replenishing the toner.

A timing at which the toner density is detected may be immediately before the copying operation restarts or during the copying operation. For example, the toner density may be detected immediately before the copying operation restarts in the first image forming operation, and may be detected during the copying operation in the subsequent image forming operation.

Also, in the inductance detecting system ATR used in this embodiment, the reference value of the detection signal in an optimum toner density (The optimum toner density is 6% in this embodiment. If the toner density is higher than that value, the toner may be scattered whereas if the toner density is lower than that value, the light image may occur,) is set to 2.5 V. If the detection signal of the sensor is larger than the reference value (for example, 3.0 V), the toner is replenished, and if the detection signal of the sensor is smaller than the reference value (for example, 2.0 V), the replenishment of the toner stops. However, the present invention is not limited to the above-described signal processing, but the circuit structure may be modified so that the reference value becomes a value of 2.5 V or more Also, the detection signal of the sensor when the toner density is lower than the optimum value may be set to be smaller so that the detection signal of the sensor may become larger when the toner density is higher than the optimum value.

In the above-described structure, as described in the above description of the related art, if the image forming apparatus such as the copying machine or the printer does not operate for a certain period of time or for a certain duration, the detection signal of the inductance detecting system ATR of the apparent magnetic permeability changes due to a variation of the bulk density of the developer within the developing container even though the toner density is not substantially changed, resulting in an error of the toner density control.

Figure 6A:
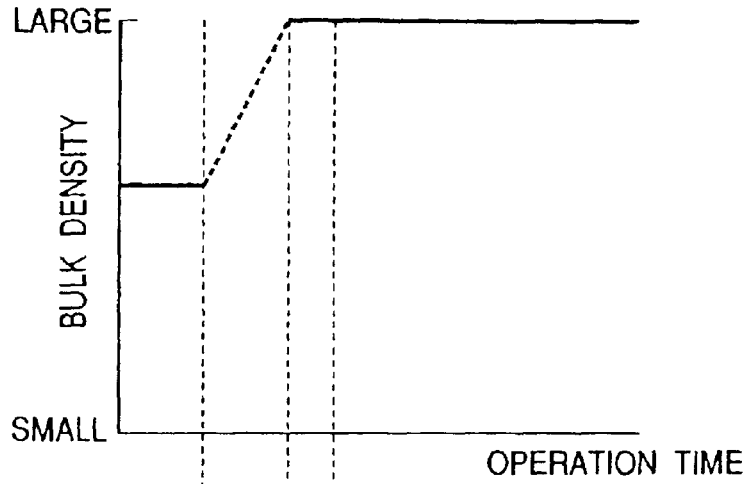
FIGS. 6A, 6B and 6C are explanatory diagrams for showing relationships of a bulk density of the developer (FIG. 6A), a sensor detection signal of the inductance detecting system ATR (FIG. 6B) and the T/C ratio of the developer (FIG. 6C) before the image forming operation stops and after the image forming operation restarts in a conventional toner replenishing control, with respect to an operating time.
Figure 6B:
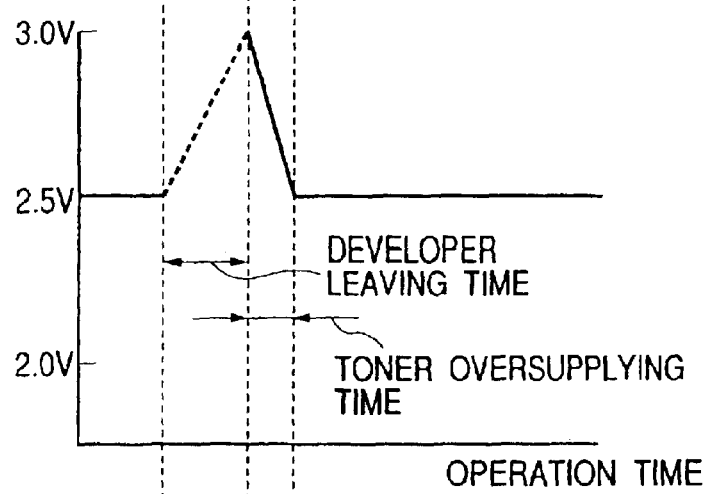
Figure 6C:
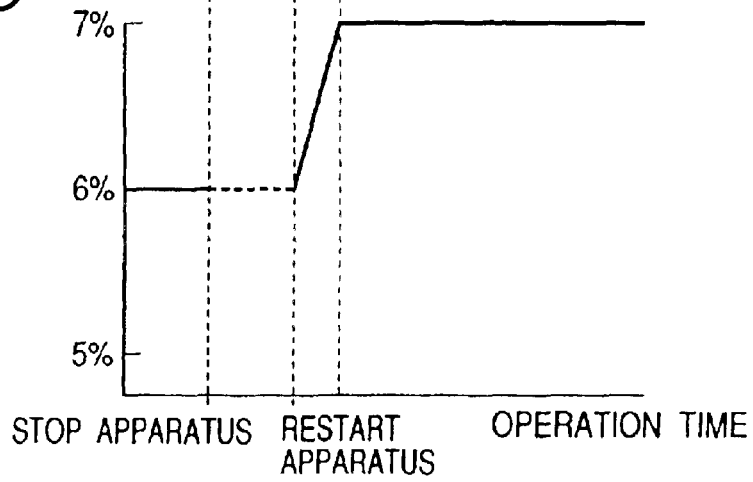

For example, as shown in FIGS. 6A, 6B and 6C, the detection signal from the inductance head 20 is 2.5 V when the optimum toner density of the developer is 6% (see FIG. 6B), and the optimum toner density is maintained immediately until the operation of the image forming apparatus stops (see FIG. 6C). However, there is a case in which as a result that the image forming apparatus does not operate because the main switch of the image forming apparatus turns off or a waiting period of waiting for an image formation start signal is long (a developer leaving time in FIG. 6B), the bulk density of the developer changes due to factors such as an environmental variation such as temperature or humidity or a change in the toner charge amount (see FIG. 6A) and the detection signal when the operation of the image forming apparatus restarts may change (see FIG. 6B).

In the inductance detecting system ATR used in this embodiment, if the detection signal is higher than the initial set value (reference value: 2.5 V in this embodiment), it is Judged that the rate of the carrier particles in the developer is high because of the circuit structure, that is, the toner density is low. As a result, the toner is excessively replenished (the toner oversupplying time in FIG. 6B), resulting in a problem that the toner density is out of the original optimum toner density and stabilized (FIG. 6C).

Under the above circumstances, in this embodiment, in order to correct an error detection of the inductance detecting system ATR due to the leaving of the developer and maintain the toner density to a constant value immediately after the leaving of the developer, the developer density control is conducted by the video count system ATR as the second developer density controller, to thereby remove the above drawback.

First, the video count system of the image density of an image information signal will be described.

The level of the output signal of the image signal processing circuit 34 shown in FIG. 1 is counted for each of the pixels. The count is conducted in this embodiment as follows: First, the output signal of the pulse width modulating circuit 35 is supplied to one input of an AND gate 64, and a clock pulse (a pulse shown in FIG. 3B) is supplied to the other input of the AND gate 64 from a clock pulse generator 65. Accordingly, clock pulses of the number corresponding to the respective pulse widths of laser driving pulses S, I and W, that is, the clock pulses of the number corresponding to the densities of the respective pixels are outputted from the AND gate 64 as shown in FIG. 3C. The number of clock pulses is integrated by the counter 66 for each of the pixels, and the number of video counts is calculated (for example, the maximum number of video counts is 400 dpi and 3884×1000000 in 256 gradations) in one sheet of A4 size. The pulse integrated signal C1 (the number of video counts) for each of the images from the counter 66 corresponds to the toner amount consumed from the developing device 44 for forming one toner image of the original 31.

Therefore, the number of video counts is supplied to the CPU 67, and the toner is appropriately replenished to the developing device 44 from a conversion table indicative of a correspondence relationship between the number of video counts and the toner replenishing time which is provided in the CPU 67, to thereby conduct a desired developer density control.

A RAM 68 is formed of a non-volatile memory into and from which various data which has been or will be calculated by the CPU 67 is written and read.

The second developer density controller according to this embodiment applies the video count system as described above, and operates on the basis of the following control.

First, as shown in FIG. 1, the detection signal from the inductance head 20 immediately before the operation of the image forming apparatus stops (for example, after a final image formation has been completed and immediately before the main switch of the image forming apparatus turns off; before the main switch turns off and during the final image forming operation; or before the waiting state of the image forming apparatus) is stored in a recording saving device 23 such as a nonvolatile memory (storing means). Then, immediately after the operation of the apparatus restarts (for example, after the main switch of the image forming apparatus turns on and before an initial image formation is conducted after the main switch turns on and during the initial image forming operation; or immediately after the image formation start signal is inputted and the waiting state of the image forming apparatus is completed and before the image formation is conducted on the basis of the image formation start signal), the detection signal immediately before the operation of the apparatus stops which is recorded in the recording saving device 23 is supplied to one input of a second comparator 24, and the detection signal is inputted to the other input of the second comparator 24 from the inductance head 20 immediately after the operation of the apparatus starts, and its difference value is transmitted to a second CPU 25 that serves as a selecting means (control means). The second CPU 25 judges whether the subsequent developer density control is sequentially conducted by only the first density controller of the inductance detecting system on the basis of the above difference value, or whether the operation is changed over to the second developer density controller of the video count system.

Specifically, in the case where the detection signal of the inductance detecting sensor immediately before the operation of the apparatus stops is 2.5 V and the sensor detection signal immediately after the operation of the apparatus restarts is 3.0 V or 2.0 V, it is judged that the bulk density of the developer is largely changed due to the leaving of the developer, and the subsequent developer density control is conducted through the video count system. Regarding a timing at which the operation changes over to the video count system depending on the detection signal difference between before and after the leaving of the developer, for example, the change-over may be made when the detection signal is changed by ±0.15 V or more than the detection signal immediately before the operation of the apparatus stops, but the change-over may not be made when the detection signal difference is less than the above value, and its threshold value can be appropriately selected.

Even if the bulk density of the developer changes due to the leaving of the developer by conducting the above control, the developer density is prevented from rapidly changing due to the malfunction of the inductance detecting sensor, thereby being capable of preventing the deterioration of the image quality such as the toner scattering or the fogged image on the background due to a rise in the developer density or the light density image due to the lowering of the developer density.

In this embodiment, since the detection signal of the developer controller immediately before the operation of the image forming apparatus stops is stored in a nonvolatile memory, even if the main power supply of the image forming apparatus is left in a switched-off state, the detection signal from the inductance head after the operation of the apparatus restarts and the above memory value can be compared with each other.

Also, in this embodiment, since the detection signal immediately after the operation of the image forming apparatus restarts is detected after the operation of the image forming apparatus restarts and before the image forming operation for a first transfer material, the judgment of the change-over to the video count system can be made more quickly than that in the case where the detection signal is detected during the image formation for the first transfer material after the operation of the image forming apparatus restarts, with the result that the deterioration of the image formed on the first transfer material due to the excessive toner replenishment can be prevented.

Second Embodiment

Subsequently, a second embodiment of the present invention will be described. The feature of this embodiment resides in that the first developer density controller and the second developer density controller which are described in the first embodiment are employed together.

The second developer density controller in this embodiment adopts the video count system as described above and operates on the basis of the following control.

First, as shown in FIG. 1, the detection signal from the inductance head 20 immediately before the operation of the apparatus stops is stored in the recording saving device 23. Then, immediately after the operation of the apparatus restarts, the detection signal immediately before the operation of the apparatus stops which is stored in the recording saving device 23 is supplied to one input of the second comparator 24, and the detection signal from the inductance head 20 immediately after the operation of the apparatus starts is inputted to the other input of the second comparator 24, and its difference value is transmitted to the second CPU 25. The second CPU 25 judges whether the subsequent developer density control is conducted by only the first density control device of the inductance detecting system on the basis of the difference value, or by using the first density controller of the inductance detecting system and the second developer density controller of the video count system together.

Specifically, in the case where the detection signal of the inductance detecting sensor immediately before the operation of the apparatus stops is 2.5 V and the sensor detection signal immediately after the operation of the apparatus restarts is 3.0 V or 2.0 V, it is judged that the bulk density of the developer is largely changed due to the leaving of the developer, and the subsequent developer density control is conducted through the inductance detecting system and the video count system together.

The toner replenishing control using the inductance detecting system ATR and the video count system ATR together will be described. As described above, in the case of the inductance detecting system ATR, a toner replenishing time t1 (that is, replenished toner amount) is obtained from a difference between the detection signal and the reference signal. Also, in the case of the video count system ATR, a toner replenishing time t2 (that is, replenished toner amount) is obtained from the number of video counts.

Accordingly, in the developer density control using the inductance detecting system ATR and the video count system ATR together, the actual toner replenishing time T is calculated by the following expression.

$T=(1-N)\times t1+N\times t2$ ($0\leqq N\leqq 1$ where N is a coefficient indicative of the rate of both the systems)

This expression means that if N is 0, the developer density control is conducted by only the inductance detecting system ATR, whereas if N is 1, the developer density control is conducted by only the video count system ATR. If N is between 0 and 1, both of the inductance detecting system ATR and the video count system ATR are used together.

For example, in the case where the detection signal difference is 0.5 V between the detection signals before and after the leaving of the developer, if the value of N is set to 0.5, the toner replenishing time T becomes:

$$T=0.5\times t1+0.5\times t2$$

In the above example, N is set to 0.5 (N=0.5). However, it is needless to say that N may be set to a different value, and it is possible to appropriately select the value of N so as to be adapted to an actual system. Also, the value of N may be changed in accordance with the above detection signal difference by the control means, thereby being capable of appropriately conducting the toner replenishing control.

Figure 9:
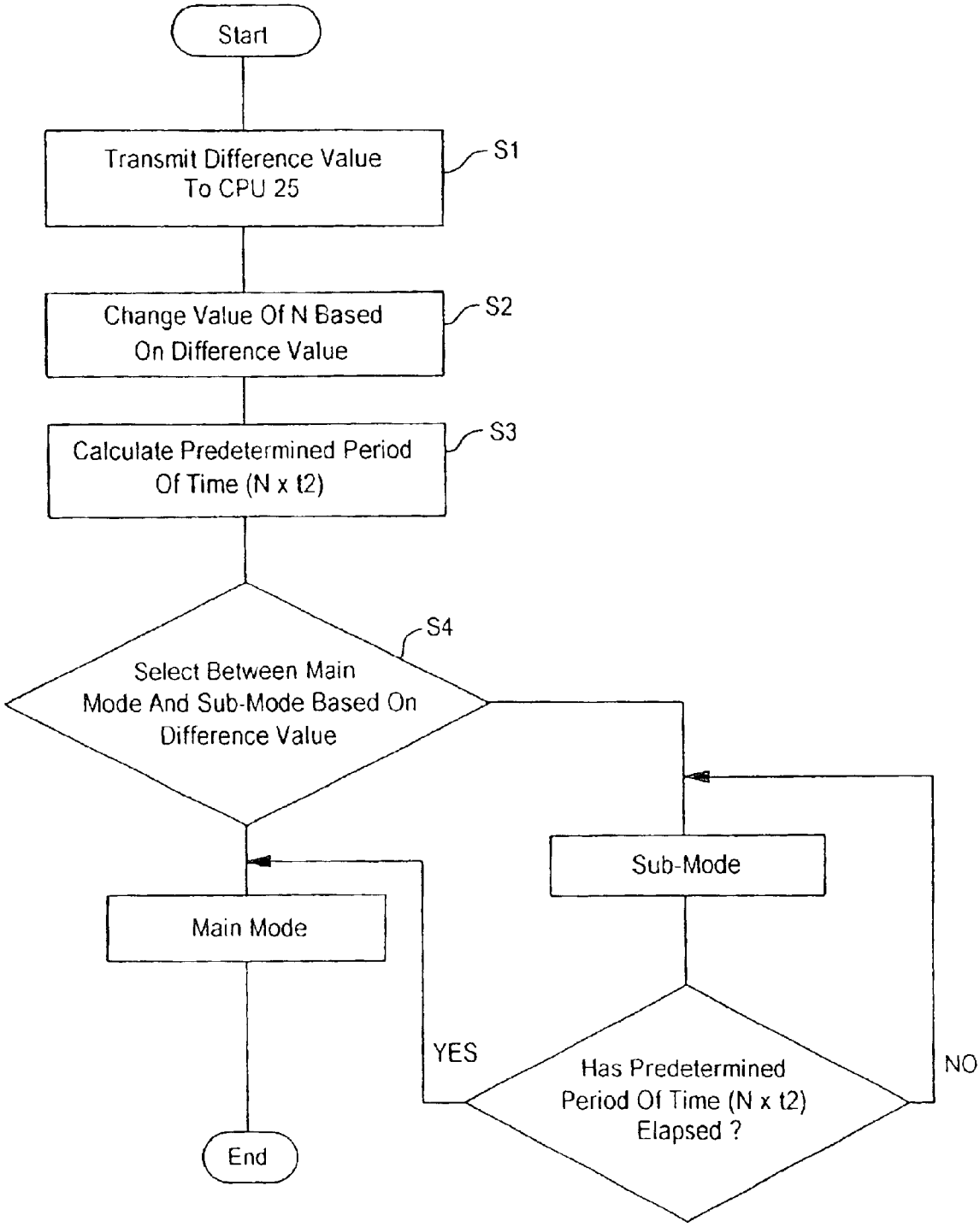
FIG. 9 is a flowchart showing the operation of an embodiment of an image forming apparatus for varying a time period extending from a time when the sub-mode is selected to a time when the sub-mode is changed to the main mode in accordance with the information detected by the detecting device.
Figure 9:
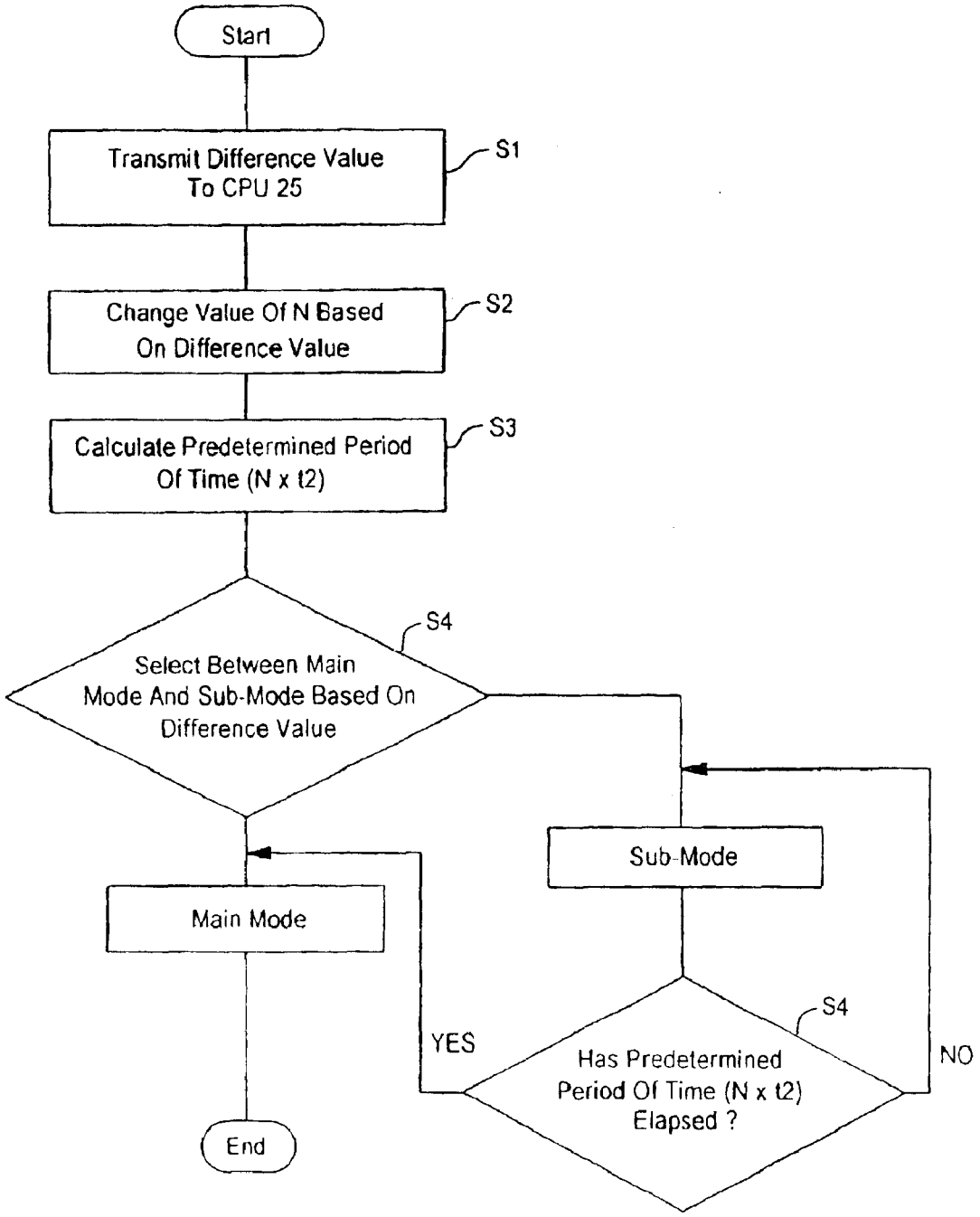

The above operation is illustrated in the flowchart shown in FIG. 9. In Step S1, in the image forming apparatus, a difference value obtained by the inductance sensor is transmitted to CPU 25. In Step S2, the value of N is changed in accordance with the difference value. In Step S3, a predetermined period of time N×t2 is calculated. In Step S4, the CPU 25 selects between a main mode and a sub-mode based on the difference value. In Step S5, label FIG. 9 in the sub-mode and after the predetermined period of time N×t2 has elapsed, the apparatus returns to the main mode if the predetermined period of time has not elapsed the apparatus returns to the sub-mode.

Through the above control, even if the bulk density of the developer is changed by the leaving of the developer, the developer density is prevented from being rapidly changed due to the malfunction of the inductance detecting sensor, thereby being capable of preventing the deterioration of the image quality such as the toner scattering or the fogged image on the background due to a rise in the developer density or the light density image due to the lowering the developer density.

Also, in this embodiment, since the detection signal of the developer controller immediately after the operation of the image forming apparatus restarts is detected after the operation of the image forming apparatus restarts and before the first image forming operation is conducted, the judgment of using the inductance detecting system and the video count system ATR together can be more quickly made than that in the case where the detection signal is detected during the first image forming operation after the operation of the image forming apparatus restarts, thereby being capable of preventing the deterioration of the image due to the excessive toner replenishment in the first image forming operation.

Third Embodiment

Subsequently, a third embodiment of the present invention will be described below.

There is a risk that when the second developer density controller of the above-described video count system conducts a large amount of image forming operation as described above, the developer density is out of an appropriate range.

On the other hand, even in the case where the environments such as temperature or humidity are remarkably changed, packing occurs due to the leaving of developer, or the charge amount is lowered, it is considered that the bulk density of the developer gradually approaches the bulk density suitable for the environments because the bulk density is gradually adapted to the environments while the normal operation of the image forming apparatus continues or because the packing of the developer is eliminated or the toner charge amount is recovered by agitating the toner within the developing container.

Under the above-described circumstances, in this embodiment, control is made in such a manner that the change-over of the developer density control of the video count system to the developer density control of the inductance detecting system, or the using of the developer density control of the inductance detecting system and the developer density control of the video count system together, is returned to the original developer density control of the inductance detecting system after a predetermined period of time elapses As a result, the developer density control immediately after the bulk density is remarkably changed due to the leaving of the developer as well as the subsequent developer density control in a state where the correlation relationship between the detection signal from the inductance head and the actual toner density substantially coincides with each other after the bulk density is stabilized due to a large amount of image forming operation, can maintain the developer density within the developing container at a predetermined value.

The above-described predetermined period of time is determined on the basis of the number of image formations, and the change-over to the developer density control of the inductance detecting system, or the developer density control using the developer density control of the inductance detecting system and the developer density control of the video count system together is returned to the developer density control of only the inductance detecting system after the images are formed on, for example, 100 sheets of transfer materials. As a result, the developer density control immediately after the bulk density is remarkably changed due to leaving of the developer, as well as the subsequent developer density control in a state where the bulk density is stabilized due to a large amount of image forming operation can be controlled to a desired value.

Also, the control may be made in such a manner that the value of N in the second embodiment is gradually reduced by the control means every time where image formation is conducted on the transfer materials of a predetermined number of sheets (every time where a predetermined number of times of detections are conducted by the inductance sensor) while a state where the developer density control of the inductance detecting system and the developer density control of the video count system are used together is returned to the developer density control by only the inductance detecting system. With this structure, the developer density control (developer replenishing control) matched by the actual toner density can be conducted, thereby being capable of preventing the failure of the image formation.

Also, as a modified example of the above predetermined period of time, since the recovery of the bulk density of the developer is directly related to the drive of the developer agitating members, that is, the first and second developer agitating screws 58 and 59 (refer to FIG. 2), the change-over to the second developer density controller or the developer density control using two systems together is returned to the first developer density controller of the inductance detecting system after, for example, a total time of the agitating periods of the agitating members reaches 10 minutes, with the results that the developer density control immediately after the bulk density is remarkably changed due to the leaving of the developer and the developer density control in a state where the bulk density is stabilized due to a large amount of subsequent image forming operation can control the developer density within the developing container to a desired value.

Also, as another modified example, the video count system can be controlled. In the control method of this type, since the number of video counts are proportional to the consumed toner amount, for example, in the case where the configuration and the surface property of the toner are changed, and the bulk density is changed as a result of sandwiching and pressing the toner among the carriers due to the leaving of the developer for a long period of time, the toner is consumed and newly replenished, to thereby return the bulk density to an initial bulk density.

Therefore, the change-over to the second developer density controller or the developer density control using the two systems together is returned to the first developer density controller of the inductance detecting system after, for example, an integral value of the number of video counts integrated after the operation of the image forming apparatus restarts reaches a predetermined value, with the results that the developer density control immediately after the bulk density is remarkably changed due to the leaving of the developer, and the developer density control in a state where the bulk density is stabilized due to a large amount of subsequent image forming operation can control the developer density within the developing container to a desired value.

Fourth Embodiment

Subsequently, a fourth embodiment of the present invention will be described.

This embodiment can obtain a larger advantage by appropriately combining the above-described first to third embodiments, respectively.

For example, in the case where the developer density control of only the video count system is conducted on the image formation onto the first transfer material immediately after the operation of the image forming apparatus restarts on the basis of the detection signal difference between the detection signals from the inductance head immediately before the operation of the image forming apparatus stops and immediately after the operation of the image forming apparatus restarts, the control may be made by the control means in such a manner that the developer density controls of the video count system and the inductance system are used together with respect to the image formation on the second and subsequent transfer materials after the operation of the image forming apparatus restarts. Then, the value of N in the second embodiment is gradually reduced every time the image formation onto a predetermined number of sheets of transfer materials is conducted (every time where a predetermined number of times of detections are conducted by the inductance sensor) so that the number of N becomes finally zero, to thereby conduct the developer density control of only the inductance system.

When the developer density control of the video count system and the developer density control of the inductance system start to be used together with respect to the image formation onto the second transfer material after the operation of the image forming apparatus restarts, it is preferable that the initial value of N is controlled by the control means in accordance with the above detection signal difference.

With the above structure, even if there is a large difference between the detection signal from the inductance head immediately after the operation of the image forming apparatus restarts and the actual toner density within the developing container, the control can cope with this excellently.

The toner particles used in this embodiment is a spherical polymer toner, and a method of manufacturing the toner is that monomer is obtained by adding a colorant and a charge control agent to the monomer of the polymerizing method and then suspended and polymerized in a water based medium, to thereby obtain spherical toner particles in this embodiment. This method is preferable when the spherical toner is inexpensively produced. The producing method is not limited to the above manner, but other methods such as an emulsion polymerization method may be employed if the spherical toner can be produced, and other additives may be mixed together.

The shape factor of the spherical ploymer toner obtained through the above-described method is 100 to 180 in SF-1 in and 100 to 140 in SF-2. The SF-1 and SF-2 are defined as values obtained by sampling 100 toners at random by using FE-SEM (S-BOO) made by Hitachi, Ltd., introducing the image information to an image analyzing device (Luzex 3) made by Nicolet Japan Corporation through an interface, analyzing the information and conducting calculation on the basis of the following expressions.

$$SF\text{-}1=\{(MXLNG)^2/AREA\}\times(\pi/4)\times 100$$

$$SF\text{-}2=\{(PERI)^2/AREA)\}(1/4\pi)\times 100$$

Where MXLNG is an absolute maximum length, AREA is a toner projected area and PERI is a peripheral length.

The shape factor SF-1 of the toner represents the degree of sphericity and becomes gradually undefined from the sphere if the numerical value is large. The SF-1 represents the degree of irregularity, and the irregularity of the surface becomes remarkable if the numerical value is large.

Since as compared with the shape factor of the above spherical polymer toner, the shape factor of the toner manufactured by using the conventional pulverizing method is 180 to 220 in SF-1 and 180 to 200 in SF-2, it is understood that the spherical polymer toner is close to a circle in the shape of the toner particles as compared with the conventional pulverized toner. The spherical polymer toner which is naturally close to a circle shows small change in the shape because factors that change the shape is little with respect to the pulverized toner. Also, the pulverized toner is wide in discrepancies in the configuration of the toner particles, and therefore also large in a change in the void ratio and bulk density. On the contrary, in the spherical polymer toner, as described above, because a change in the shape of the toner particles is small, a change in the bulk density is also small, and an error in the detection signal of the inductance detecting system ATR when the developer is left is also small.

It is not particularly necessary to produce the above spherical polymer toner by polymer toner, but other methods may be applied if the spherical toner can be produced.

Fifth Embodiment

Figure 7:
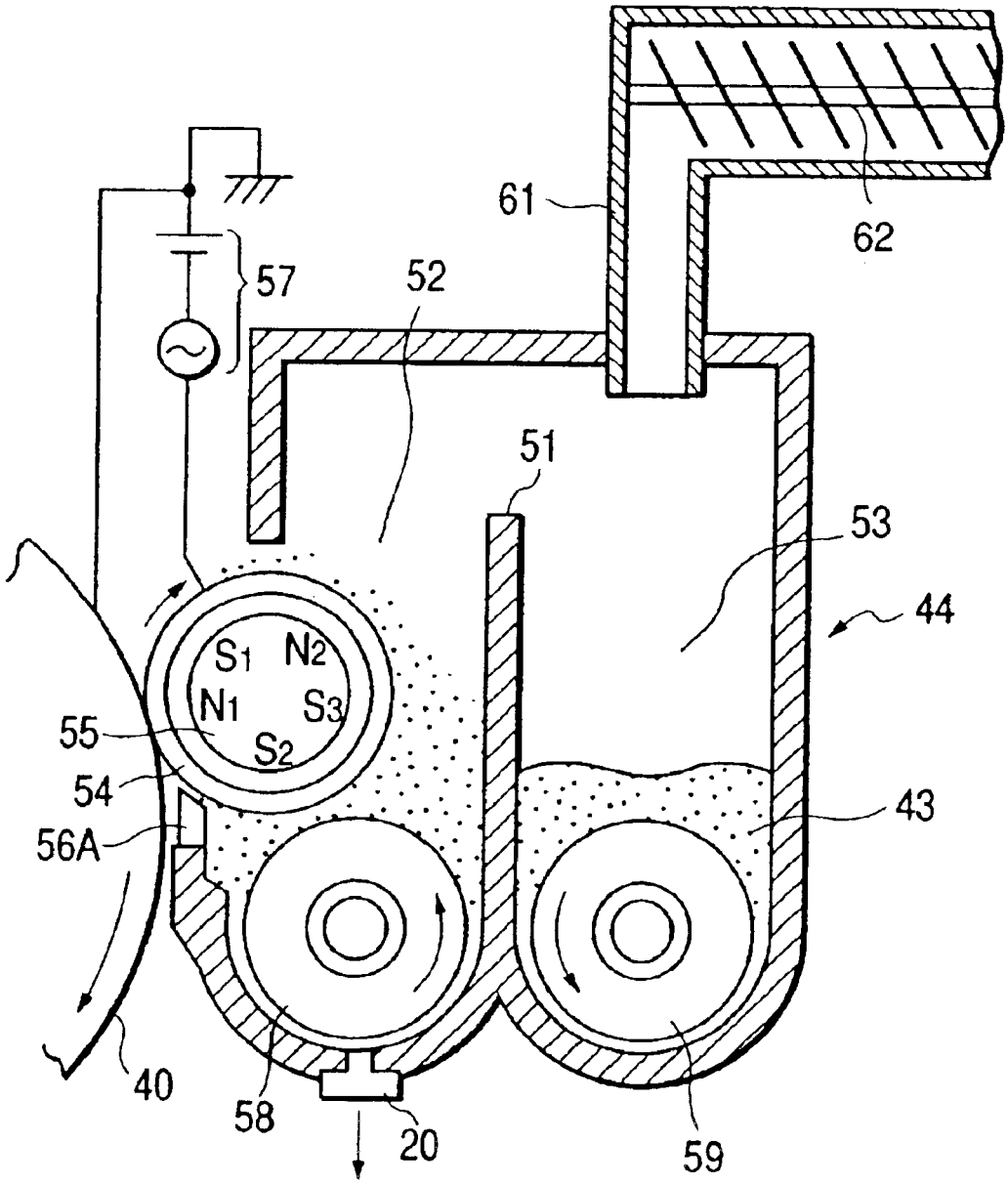
FIG. 7 is a structural diagram showing the outline of a developer that rotates a developing sleeve in a counter direction to a photosensitive drum rotating direction.

Subsequently, a fifth embodiment of the present invention will be described with reference to FIG. 7. The structural feature of this embodiment resides in that as shown in FIG. 7, the developing sleeve 54 that functions as a developer bearing member is rotated in a counter direction to a direction of rotating the photosensitive drum 40. That is, in this embodiment, the structure of the developing device is only different from that in the above first to fourth embodiments, and other structures are identical with those in the first to fourth embodiments, and the structures other than the developing device can be applied with the structures in the first to fourth embodiments similarly.

As shown in FIG. 7, in the structure where the developing sleeve 54 rotates in a counter direction to the direction of rotating the photosensitive member, the developer 43 in the developing chamber 52 is carried by using an S2 pole of the magnet 55 as a magnetic field generating means, and after the developer 43 is coated on the developing sleeve 54, the developer 43 coated on the developing sleeve 54 is regulated by a blade 56A as the developer regulating member, to thereby regulate the coating amount on the developing sleeve 54.

For that reason, as compared with the structure where the developing sleeve 54 rotates in a forward direction of the photosensitive member rotating direction shown in FIG. 2 in which the developer becomes sequentially full in the vicinity of the regulating blade 56 of the developing blade 54, the compression of the developer by the regulating blade 56A of the developing sleeve 54 is reduced, as a result of which the deterioration of the developer can be prevented, and a variation in the toner charge amount can be reduced.

The above-described fact can reduce a change in the bulk density of the developer due to a change in the shape of the toner, or a change in the toner charge amount due to the developer compression, to thereby lead to a reduction in the change of the bulk density due to the repulsion between the developers. The error in the sensor detection signal immediately after the operation of the device restarts can be reduced in the inductance detecting system ATR as compared with the conventional system where the developing sleeve rotates in the forward direction with respect to the photosensitive drum as in the conventional example.

Sixth Embodiment

The feature of this embodiment resides in that a change in the toner charge amount is reduced by changing the material and physical property of the carriers in the developer in the above-described embodiment. The structure of the image forming apparatus can be applied with the structure of the first to fifth embodiments except for the structure of the carriers, likewise.

Figure 8A:
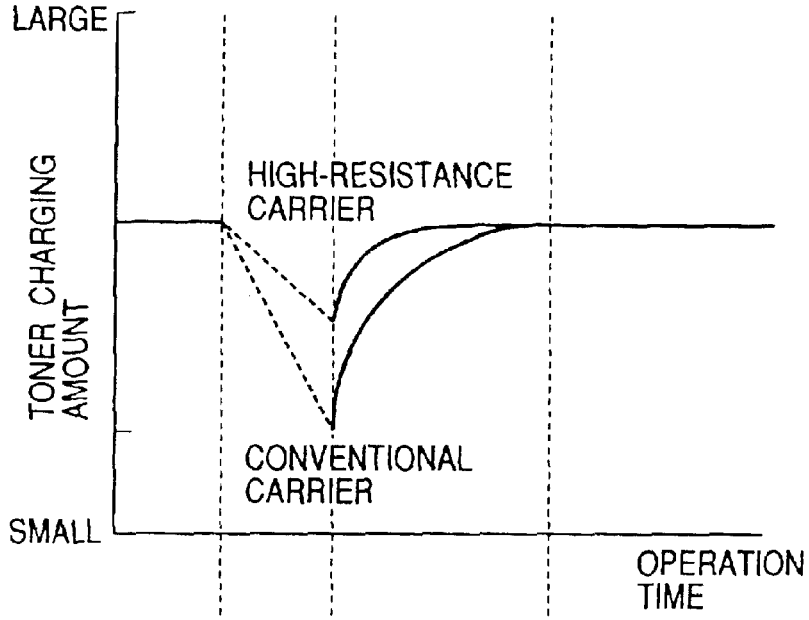
FIGS. 8A and 8B show a relationship of the bulk density of the developer (FIG. 8A) and a sensor detection signal of the inductance detecting system ATR (FIG. 8B) before the image forming operation stops and after the image forming operation restarts using ferrite magnetic carriers used up to now and high-resistance carriers which is capable of reducing the triboelectricity change amount in a sixth embodiment with respect to an operating time.
Figure 8B:
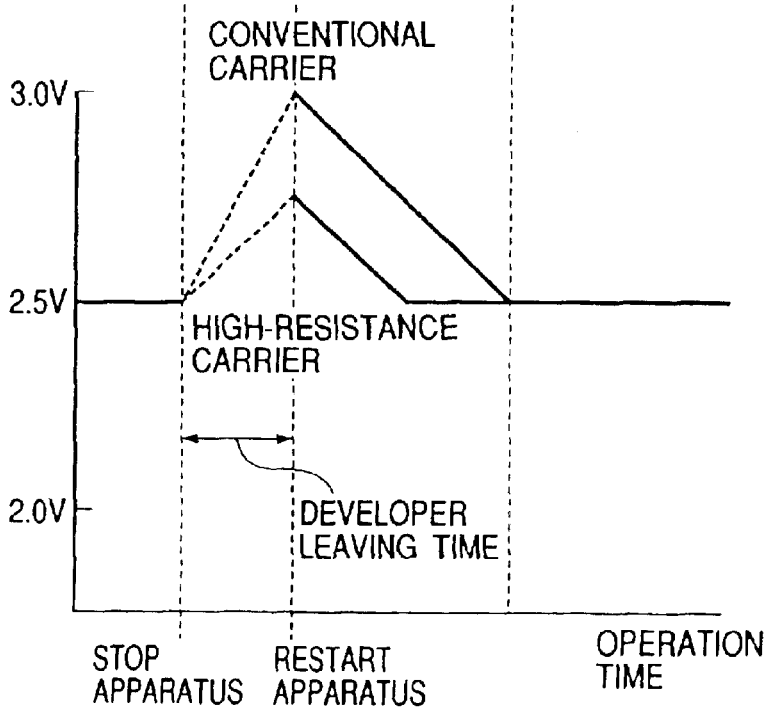

FIGS. 8A and 8B show a difference between the sensor detection signals immediately before the operation of the apparatus stops and immediately after the operation of the apparatus restarts with respect to a difference between the toner charge amount of the ferrite magnetic carriers used up to now and the toner charge amount of the high resistant carriers that can reduce the triboelectricity change amount in this embodiment due to the leaving of the developer.

It is understood from FIGS. 8A and 8B that the high resistant carriers of this embodiment is small in a change in the toner charge amount due to the leaving of the developer as compared with the conventional carriers.

The present inventors have considered causes that create the above differences as follows: the high resistant carriers in this embodiment and the ferrite magnetic carriers are different in its specific resistance (volume resistivity), and the ferrite magnetic carriers itself are low in the resistance, that is, $1\times10^9$ to $1\times10^{10}$ Ωcm. On the contrary, because the high resistant carriers are high, that is, $1\times10^{10}$ to $1\times10^{14}$ Ωcm, it is considered that the charges stored in the carriers once is difficult to decay, and a variation in the charge of the carriers when the developer is left is small, as a result of which a change in the charge amount of stuck toner is also small.

The high resistant carriers in this embodiment are produced by the polymerizing method as a resin magnetic carrier consisting of a binder resin, a magnetic metal oxide and a nonmagnetic metal oxide, However, if the resistance can be adjusted by another manufacturing method, its carriers may be used.

The above-described respective embodiments show cases where the present invention is applied to a digital copying machine of the electrophotographic system. However, the present invention can be likewise applied to various copying machines such as an electrophotographic system other than the above embodiments or the electrostatic recording system, and the image forming apparatus such as a printer. For example, the present invention can be applied to the image forming apparatus that conducts the contrast expression of an image by a dither method, and can be also applied to not an original copy, but the image forming apparatus that forms the toner image in accordance with the image information signal outputted from a computer or the like. In addition, it is needless to say that the structures of the image forming apparatus and the control system can be deformed or altered as occasion demands.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An image forming apparatus, comprising:

an image bearing member on which a latent image corresponding to image information is formed;

developing means for developing the latent image formed on said image bearing member with a developer including a carrier and a toner;

supplying means for supplying the toner to said developing means;

detecting means for detecting a magnetic permeability of the developer;

counting means for counting pixel information corresponding to the image information; and selecting means for selecting between a first mode in which an amount of the toner supplied from said supplying means to said developing means is controlled on the basis of an output from said detecting means and a second mode in which the amount of the toner supplied from said supplying means to said developing means is controlled on the basis of an output from said counting means, wherein said selecting means selects between the first mode and the second mode in accordance with a difference value between a value detected by said detecting means before a stop of an image forming operation and a value detected by said detecting means after a start of an image forming operation after the stop of the image formation operation.

2. An image forming apparatus according to claim 1, wherein when the difference value is equal to or larger than a predetermined value, said selecting means selects the second mode.

3. An image forming apparatus according to claim 2, wherein after said selecting means performs the second mode for a predetermined period of time, said selecting means switches from the second mode to the first mode.

4. An image forming apparatus according to claim 2, wherein after said selecting means performs a predetermined number of image formations in the second mode, said selecting means switches from the second mode to the first mode.

5. An image forming apparatus, comprising:

an image bearing member on which a latent image corresponding to image information is formed;

developing means for developing the latent image formed on said image bearing member with the developer including a carrier and a toner;

supplying means for supplying the toner to said developing means;

detecting means for detecting information corresponding to a magnetic permeability of the developer;

counting means for counting pixel information corresponding to the image information; and selecting means for selecting between a first mode in which an amount of the toner supplied from said supplying means to said developing means is controlled on the basis of an output from said detecting means and a second mode in which the amount of the toner supplied from said supplying means to said developing means is controlled on the basis of the output from said detecting means and an output from said counting means, wherein said selecting means selects between the first mode and the second mode in accordance with a difference value between a value detected by said detecting means before a stop of an image forming operation and a value detected by said detecting means after a start of an image forming operation after the stop of the image forming operation.

6. An image forming apparatus according to claim 5, wherein when the difference value is equal to or larger than a predetermined value, said selecting means selects the second mode.

7. An image forming apparatus according to claim 6, further comprising controlling means for calculating, in the second mode, an amount of the toner to be supplied by using, with a use rate defined by a predetermined coefficient, both of a value relating to a toner supply corresponding to the output from said detecting means and a value relating to a toner supply corresponding to the output from said counting means, and for controlling said supplying means to perform a toner supplying operation for the calculated amount.

8. An image forming apparatus to claim 7, wherein said controlling means assigns a value corresponding to the output from said detecting means to the predetermined coefficient.

9. An image forming apparatus according to claim 7, wherein said controlling means changes the predetermined coefficient so that a use rate of the value relating to the toner supply corresponding to the output from said detecting means becomes larger in accordance with an increase in a number of image formations.

10. An image forming apparatus according to claim 6, wherein after said controlling means performs the second mode for a predetermined period of time, said controlling means switches from the second mode to the first mode.

11. An image forming apparatus according to claim 6, wherein after said controlling means performs a predetermined number of image formations in the second mode, said controlling means switches from the second mode to the first mode.

* * * * *

UNITED STATES PATENT AND TRADEMARK OFFICE

CERTIFICATE OF CORRECTION

PATENT NO. : 7,013,096 B2
APPLICATION NO. : 10/765169
DATED : March 14, 2006
INVENTOR(S) : Ichiro Ozawa et al.

It is certified that error appears in the above-identified patent and that said Letters Patent is hereby corrected as shown below:

IN THE DRAWINGS:

In Sheet 8, Figure 9, the box containing the step "Has Predetermined Period Of Time (N×t2) Elapsed?" should be denoted by reference character --S4--. See Attached

COLUMN 1:

Line 25, "well" should read --is well--;
Line 29, "is" should read --are--; and
Line 42, "in" should read --into--.

COLUMN 3:

Line 18, "particles)within" should read --particles) within--.

COLUMN 4:

Line 13, "and" should be deleted;
Line 20, "change" should read --charge--; and
Line 21, "time." should read --time; and--.

COLUMN 6:

Line 40, "member- that" should read --member that--; and
Line 42, "an" should read --a--.

COLUMN 7:

Lines 30 and 31, "nonmagnetic carriers," should read --nonmagnetic toner,--; and
Line 50, "supply 22" should read --supply 22.--.

UNITED STATES PATENT AND TRADEMARK OFFICE

CERTIFICATE OF CORRECTION

PATENT NO. : 7,013,096 B2
APPLICATION NO. : 10/765169
DATED : March 14, 2006
INVENTOR(S) : Ichiro Ozawa et al.

It is certified that error appears in the above-identified patent and that said Letters Patent is hereby corrected as shown below:

COLUMN 8:

Line 56, "more" should read --more.--.

COLUMN 9:

Line 23, "Judged" should read --judged--.

COLUMN 13:

Line 18, "elapses" should read --elapses.--; and
Line 39, "leaving" should read --the leaving--.

COLUMN 15:

Line 28, "SF-2={(PERI)$^2$/AREA)}(V4π)×100" should read --SF-2+{(PERI)$^2$/AREA}×(1/4π)×100--; and
Line 44, "is" should read --are--.

COLUMN 18:

Line 48, "apparatus" should read --apparatus according--.

Signed and Sealed this

Seventeenth Day of October, 2006

JON W. DUDAS
*Director of the United States Patent and Trademark Office*